US010752387B2

(12) United States Patent
Jonker et al.

(10) Patent No.: US 10,752,387 B2
(45) Date of Patent: Aug. 25, 2020

(54) METHOD AND SYSTEM FOR CREATING CUSTOM-SIZED CARDBOARD BLANKS FOR PACKAGINGS AND METHOD AND SYSTEM FOR AUTOMATICALLY PACKAGING SHIPMENT SETS IN BOXES

(71) Applicant: Neopost Technologies, Bagneux (FR)

(72) Inventors: Melle Jonker, Drachten (NL); Eelke Visser, Drachten (NL); Valery Grushka, Drachten (NL); Jelle Wiersma, Drachten (NL); Peter van Eijk, Drachten (NL)

(73) Assignee: QUADIENT TECHNOLOGIES FRANCE, Bagneux (FR)

( * ) Notice: Subject to any disclaimer, the term of this patent is extended or adjusted under 35 U.S.C. 154(b) by 0 days.

(21) Appl. No.: 16/264,238

(22) Filed: Jan. 31, 2019

(65) Prior Publication Data

US 2019/0233142 A1 Aug. 1, 2019

(30) Foreign Application Priority Data

Jan. 31, 2018 (DE) ..... 10 2018 102 197

(51) Int. Cl.
*B65B 59/00* (2006.01)
*B65B 5/02* (2006.01)
(Continued)

(52) U.S. Cl.
CPC ..... *B65B 5/024* (2013.01); *B31B 50/006* (2017.08); *B65B 5/06* (2013.01); *B65B 43/10* (2013.01);
(Continued)

(58) Field of Classification Search
CPC ..... B65B 43/10; B65B 2210/04; B65B 59/00; B65B 59/02; B31B 50/16; B31B 50/25
(Continued)

(56) References Cited

U.S. PATENT DOCUMENTS

1 A 7/1836 Ruggles
1,998,357 A 4/1935 Martin
(Continued)

FOREIGN PATENT DOCUMENTS

EP 1284320 A2 2/2003
EP 1403034 A2 3/2004
(Continued)

OTHER PUBLICATIONS

Decision to grant a European patent pursuant to Article 97(1) EPC, dated Jan. 25, 2018, for European Application No. 15164748.4-1016 / 3050809, 2 pages.
(Continued)

*Primary Examiner* — Chelsea E Stinson
(74) *Attorney, Agent, or Firm* — Cozen O'Connor

(57) ABSTRACT

A system for creating custom-sized cardboard blanks for folding packagings comprises a first and at least a second supply for fanfold cardboard, a control unit (e.g., microprocessor) that calculates, based on order information regarding the desired minimum dimensions of a current packaging, under predefined optimization criteria a first blank layout for folding the packaging, said blank layout comprising a leading edge and an ending edge and transverse and longitudinal crease lines dividing the blank having a desired length and width into panels, defines, based on predefined criteria, areas around the transverse crease lines and the leading and ending edges, in which no transverse folds from fanfolding the cardboard should be present, sensors communicatively coupled with said control unit that sense information indicative of a presence of transverse folds in cardboard, a cutter to cut-off the piece of cardboard from the first or the second web and form the desired blank.

19 Claims, 5 Drawing Sheets

(51) Int. Cl.

| | |
|---|---|
| ***B65B 43/10*** | (2006.01) |
| ***B65B 5/06*** | (2006.01) |
| ***B31B 50/00*** | (2017.01) |
| *B31B 110/35* | (2017.01) |
| *B31B 50/16* | (2017.01) |
| *B31B 50/25* | (2017.01) |
| *B31B 100/00* | (2017.01) |
| *B31B 120/10* | (2017.01) |
| *B31B 50/10* | (2017.01) |

(52) U.S. Cl.
CPC ..... *B31B 50/10* (2017.08); *B31B 50/16* (2017.08); *B31B 50/25* (2017.08); *B31B 2100/002* (2017.08); *B31B 2110/35* (2017.08); *B31B 2120/102* (2017.08); *B65B 2210/04* (2013.01)

(58) Field of Classification Search
USPC ..... 53/456; 493/25, 74, 162
See application file for complete search history.

(56) References Cited

U.S. PATENT DOCUMENTS

| | | | | |
|---|---|---|---|---|
| 2,170,759 | A | 8/1939 | Howard et al. | |
| 2,242,514 | A | 5/1941 | De | |
| 2,957,395 | A | 10/1960 | Meyer | |
| 3,013,477 | A | 12/1961 | Meyer | |
| 3,513,757 | A | 5/1970 | Frank | |
| 3,631,769 | A | 1/1972 | Hammerle | |
| 4,006,656 | A | 2/1977 | Shinomiya | |
| 4,080,878 | A | 3/1978 | Gallagher et al. | |
| 4,086,116 | A | 4/1978 | Yazaki et al. | |
| 4,314,868 | A | 2/1982 | Hirakawa et al. | |
| 5,158,525 | A | 10/1992 | Nikkel | |
| 5,352,178 | A | 10/1994 | Pazdernik | |
| 5,624,368 | A | 4/1997 | Cromwell | |
| 5,632,713 | A | 5/1997 | Canning et al. | |
| 5,888,183 | A | 3/1999 | Ruthenberg et al. | |
| 5,944,252 | A | 8/1999 | Connelly et al. | |
| 6,413,150 | B1 | 7/2002 | Blair | |
| 6,684,749 | B2 | 2/2004 | Adami | |
| 8,196,502 | B2 | 6/2012 | Von | |
| 8,282,537 | B2 | 10/2012 | Gebhardt et al. | |
| 8,398,533 | B2 | 3/2013 | Tsunoda | |
| 10,081,152 | B2 | 9/2018 | Huizinga et al. | |
| 10,155,352 | B2 * | 12/2018 | Sytema | B65B 5/024 |
| 10,287,047 | B2 * | 5/2019 | Zeilstra | B65B 5/06 |
| 2008/0020916 | A1 * | 1/2008 | Magnell | B65B 59/001 493/65 |
| 2013/0000252 | A1 * | 1/2013 | Pettersson | B65B 5/024 53/396 |
| 2013/0029825 | A1 | 1/2013 | Rich | |
| 2013/0090222 | A1 | 4/2013 | Green | |
| 2013/0210597 | A1 | 8/2013 | Pettersson | |
| 2015/0360433 | A1 | 12/2015 | Feijen et al. | |
| 2016/0185065 | A1 | 6/2016 | Sytema et al. | |
| 2016/0185475 | A1 * | 6/2016 | Pettersson | B65B 59/02 53/493 |
| 2017/0190134 | A1 | 7/2017 | Van Der Dong et al. | |
| 2017/0210500 | A1 * | 7/2017 | Sytema | B65B 49/00 |
| 2017/0217620 | A1 * | 8/2017 | Zeilstra | G05B 19/402 |
| 2017/0355166 | A1 | 12/2017 | Jonker | |
| 2018/0117870 | A1 | 5/2018 | Zeilstra et al. | |
| 2018/0215117 | A1 | 8/2018 | De Boer et al. | |
| 2018/0215485 | A1 * | 8/2018 | Koet | B65G 1/1378 |
| 2019/0092513 | A1 | 3/2019 | De Boer et al. | |

FOREIGN PATENT DOCUMENTS

| | | | |
|---|---|---|---|
| EP | 2474397 | A1 | 7/2012 |
| EP | 3050809 | A1 | 8/2016 |
| FR | 2554417 | A1 | 5/1985 |
| FR | 2784656 | A1 | 4/2000 |
| FR | 2987824 | A1 | 9/2013 |
| GB | 371751 | A | 4/1932 |
| GB | 2167043 | A | 5/1986 |
| WO | 2010029416 | A2 | 3/2010 |
| WO | 2010056894 | A1 | 5/2010 |
| WO | 2010091043 | A1 | 8/2010 |
| WO | 2013117852 | A1 | 8/2013 |
| WO | 2014117816 | A1 | 8/2014 |
| WO | 2014117817 | A1 | 8/2014 |
| WO | 2014119439 | A1 | 8/2014 |
| WO | 2014188010 | A2 | 11/2014 |
| WO | 2014191334 | A1 | 12/2014 |
| WO | 2016059218 | A1 | 4/2016 |
| WO | 2016157089 | A1 | 10/2016 |

OTHER PUBLICATIONS

Extended European Search Report, dated Aug. 21, 2017, for European Application No. 17154070.1-1708, 6 pages.
Extended European Search Report, dated Jul. 11, 2017, for European Application No. 16191536.8-1708, 5 pages.
Extended European Search Report, dated May 10, 2017, for European Application No. 16196482.0-1708, 7 pages.
Extended European Search Report, dated May 15, 2017, for European Application No. 16191531.9-1708, 6 pages.
Extended European Search Report, dated May 28, 2018, for European Application No. 17193537.2, 9 pages.
Extended European Search Report dated Jun. 17, 2019, for European Application No. 19154944.3-1016, in 7 pages.

* cited by examiner

METHOD AND SYSTEM FOR CREATING CUSTOM-SIZED CARDBOARD BLANKS FOR PACKAGINGS AND METHOD AND SYSTEM FOR AUTOMATICALLY PACKAGING SHIPMENT SETS IN BOXES

TECHNICAL FIELD

The invention relates to a method and a system for creating custom-sized cardboard blanks for folding packagings from a piece of corrugated cardboard cut-off from a web of fanfold cardboard, said cardboard having transverse folds from fanfolding. The invention also relates to a method and a system for automatically packaging shipment sets in custom-sized cardboard boxes. More particularly, the invention relates to automating the packaging of varying shipment sets, i.e. sets, in which at least the number, usually the number and the size of the items vary.

BACKGROUND

Mail ordering has become a widely used way of buying goods. More and more companies offer virtual department stores, in which the customers can electronically put goods in a shopping cart that later will be transferred by the respective company into a dispatch order so that in a warehouse a shipment set comprising one or more items that have been ordered (and sometimes additional items such as samples, vouchers, invoices, etc.) can be assembled based on the respective dispatch order.

While assembling a shipment set in a warehouse of a specialized distributor is nowadays often done more or less fully automated, packaging the items to be shipped is still a challenge, in particular when a shipment set comprises several items of different sizes and in different quantity. Often, the items to be packaged are provided automatically to a person packaging the items manually. Depending on the size and number of the items, the person selects a suitable box size. Generally, the box is a cardboard box that upon packaging is assembled from a corresponding cardboard blank.

As used herein the term "blank" refers to a piece of cardboard having numerous rectangular panels delimited from each other via longitudinal and transverse crease lines and (optionally) incisions, facilitating the folding of a packaging from the blank.

As used herein the term "packaging" refers to all types of packaging means foldable from cardboard such as in particular boxes with or without lids, lids for boxes, inlays for boxes to hold individual items such as glasses and bottles etc.

As used herein, the term "panel" refers to substantially rectangular areas either of a stack of fanfold cardboard or of the blank. The panels of the blank form in the folded state the sides of a packaging such as the bottom, the top and the lateral sides of a box.

While it is obvious that for a person viewing a closed box the terms "length", "width" and "height" depend on the respective perspective, from which the box is viewed, for sake of clarity and simplicity these terms as used herein relate to dimensions in specific directions. According to at least one aspect of the invention, the cardboard blanks are made from cardboard cut to length from a long web of so called double-faced corrugated cardboard, i.e. cardboard, in which a corrugated layer is sandwiched between two flat layers. As used herein, the length of the blank is the dimension of the blank in the direction of the length of the web from which it is cut, and the width of the blank is the dimension in the direction of the width of said web. Longitudinal crease lines run in the length direction, transverse crease lines in the width direction. Each panel of the blank has accordingly a length being the dimension of the panel in said length direction and a width being the dimension of the panel in said width direction. The dimensions of the panels determine the dimensions of the packaging folded therefrom, and as used herein the length of a packaging such as a box is the dimension of the box seen in the length direction of the blank, from which it is folded, the width of the box is the dimension of the box seen in said width direction of said blank, and the height of the box is the dimension of the box in a direction perpendicular to both, length and width direction.

US 2008 0020916 A1 discloses a box-making machine, which executes creasing and cutting acts to obtain a cardboard blank, which is then folded to obtain a packaging box from the blank. One or more embodiments of invention may be advantageously used in this type and similar types of machines and systems like for example the one disclosed in WO 2014 117817 A1.

To further automate the packaging process even in cases where the items vary in size and number, WO 2014 117817 A1 discloses a system that allows—within the boundaries imposed by the material used—creating a fully custom-sized box, i.e. a box, of which width, length and height are adapted to the respective content of the box. The box is created from cardboard continuously fed to the system by cutting out and creasing a custom-sized blank from which the box including panels to form a lid is folded automatically around one or more items to be packaged.

Double-faced corrugated cardboard has a rather high stiffness, which is advantageous for making packagings, but which prevents to wind a long (for example 1000 m long and about 0.8 m wide) cardboard web up for storing it in form of a roll. Hence, the web is fanfold into a stack of panels. However, fanfolding the cardboard has the disadvantage that there are transversal fold lines (hereinafter simply called "folds") present in the source material at the positions where the panels are connected. As these folds are usually not at positions where crease lines are needed in a blank that is to be cut from the source material, they are typically called "unwanted folds" or "false folds". This is especially the case, when the sizes of the blanks to be cut vary while the panels in a stack of cardboard have a fixed size.

When such false folds are present in a blank close to wanted crease lines, there is a high risk that the blank will not be folded at the intended crease lines, but at the false folds. Likewise, if a false fold is present close to the so-called leading edge of a blank, the first panels in the transport direction of the blank may be not be gripped properly or, if these first panels are panels used for closing the packaging, may be difficult to attach for example by hot melt glue to a respective other panel. Thus, false folds may cause undesired effects during or after the folding process, may jam in the machine, may cause stops of the complete packaging system and may result in an undesired appearance and insufficient stability of the packaging. Note that the terms "leading" and "ending" edge originate from the transport direction, in which cardboard fanfold cardboard is fed. The leading edge of the blank is the ledge that formed—prior to cutting-off a piece of cardboard for creating the blank—the leading edge of the web. Once cut-off, the opposite edge of the cardboard piece cut-off forms the end of the blank and is therefore called the "ending edge"

In order to solve the problem of false folds, an apparatus and a method have been suggested in WO 2014 188010 A2 that allow rigidifying cardboard having at least one transversal fold and thus obtaining packaging material with increased stiffness from a stack of fanfold cardboard by applying creasing means to form for example line-shaped indentations on at least one side of said cardboard, wherein at least some of said indentations intersect the unwanted transversal folds, which increases the stability of the cardboard at the respective area. However, additional crease lines may—depending on the specific blank layout—also lead to an undesired appearance and only work well if there is a certain minimum distance between an unwanted fold with intersecting stabilizing indentations and a wanted crease line parallel to the unwanted fold.

While the apparatus and method disclosed in WO 2014 188010 A2 work perfectly well in many cases, just forming indentions that intersect false folds may not in all cases lead to sufficient stiffness, in particular when rather thin material is used and/or the formed packagings are rather big and/or items to be packaged are rather heavy.

Different other approaches to handle the problems associated with unwanted folds present in fanfold cardboard are disclosed in US 2018 0201465 A1. If it is determined that an unwanted fold would be present within a certain distance to a wanted crease line, depending on the position of the unwanted fold either a piece of cardboard containing the unwanted fold is completely cut away or the leading edge of the cardboard presently processed is cut off to a certain amount in order to ensure that the unwanted fold, although still present in the cardboard, would be at a certain minimum distance to the wanted crease lines. However, these approaches are necessarily associated with the production of waste material. If a packaging system using custom-sized boxes allows to forecast at least two consecutive shipment sets needing differently sized boxes, US 2018 0201465 A1 proposes to check, if one of the boxes would need a blank, in which the unwanted fold would be at a position not interfering with the wanted crease lines and, if so, to shift the order of packaging the shipment sets accordingly. However, in high speed automated packaging systems this would require additional handling and "parking" areas, in which a shipment set that is currently in front of another set but for which a box is required, whose blank would have an unwanted fold close to a wanted crease line, could be "parked" in order to let another shipment set be processed first, if this shipment set requires a card board blank, in which the unwanted fold has the certain minimum distance to a wanted crease line. In particular if the shipment sets contain numerous items varying in size that are manually arranged for being automatically packaged, it is difficult to predict well in advance, what actual dimensions a box for this specific shipment set would need to have. Accordingly, just one parking area may not be sufficient in order to avoid that always blanks can be produced, in which the unwanted folds have sufficient distance to wanted crease lines.

DISCLOSURE OF THE EMBODIMENTS INVENTION

A method and a system for creating custom-sized cardboard blanks for folding packagings from a piece of corrugated cardboard cut-off from a web of fanfold cardboard, said cardboard having transverse folds from fanfolding, may advantageously allow substantially reducing the amount of waste material and ensuring in many cases that unwanted folds have the minimum distance to wanted crease lines and the transverse edges, which minimum distance is necessary to avoid the aforementioned problems associated with the presence of unwanted folds in cardboard blanks. In another aspect, a method and a system for automatically packaging shipment sets in custom-sized cardboard boxes are described.

These and other objects are achieved by the systems and methods according to the independent claims. The respective dependent claims relate to advantageous specific embodiments of the invention.

According to one embodiment of a method for creating custom-sized cardboard blanks for folding packagings from a piece of corrugated cardboard cut-off from a web of fanfold cardboard, said cardboard having transverse folds from fanfolding, comprises an act of calculating, based on order information regarding the desired minimum dimensions of a current packaging, under predefined optimization criteria a first blank layout for folding the packaging, said blank layout comprising a leading and an ending edge and transverse and longitudinal crease lines dividing the blank having a desired length and width into panels. The blank may also comprise incisions or cutouts facilitating the folding of certain panels into the desired packaging.

Order information is information on the desired dimensions of a current packaging, i.e. a packaging that shall be produced next. Such order information may be obtained from a data base comprising the necessary information regarding the dimensions of the packaging. In most cases however, the order information will be obtained by obtaining the dimensions width, height and length of a packaging needed for packaging a specific shipment set of one or more items. These dimensions can be obtained for example by scanning the maximum outer dimensions of a shipment set arranged at a respective arranging station with a laser scanner or other suitable structure for obtaining dimensions. The dimensions may also be obtained from a data base containing information on the individual items, and it may also be foreseen that a corresponding control unit calculates based on information about the dimensions of the individual items forming a shipment set a virtual arrangement of the items that is optimal with respect to certain optimization criteria such as volume of the box, and that this virtual arrangement is displayed to a person arranging the items for being automatically packaged. The predefined optimization criteria can be prioritized by a customer using the method respectively a corresponding system employing the method, and typically comprise criteria such as minimum volume of the packaging, maximum stability of the packaging etc.

Typically, the first layout will be a layout, in which the blank has a width close to the width of the cardboard web, but allowing that a certain minimum margin is cut-off at both longitudinal edges of the web, since these sides often have little damages from transportation. The longitudinal edges of the web are the parallel sides defining the width of the web. As is apparent from the disclosure herein, the panels of the blank define the dimensions of a packaging folded from the blank, for example in a blank for folding a box having a bottom panel, the length of the bottom panel of the blank defines the length of the box and the width of the bottom panel defines the width of the box. Obviously, there are always at least two options for folding a box having the same outer dimensions width and length, namely by turning the orientation of the bottom panel by 90° within the plane of the bottom panel, such that length becomes width and width becomes length. Depending on the dimensions of the web and the packaging to be folded, typically at least two blanks resulting in the same packaging but with interchanged width and length dimensions of certain panels can be formed from the same web.

Once a first layout has been chosen, based on predefined criteria areas around the transverse crease lines and the leading and ending edges of the layout, in which no transverse folds should be present, are defined. It should be noted that depending on the respective transverse crease line, the areas may have different extensions in the longitudinal direction, which for example depends on the way, in which the respective packaging is folded and the abilities of a mechanical system folding the packaging. Typically panels, which in a direction of transporting the blank are first panels, are more sensible to transverse folds and hence a transverse fold should have further distance to the leading edge and the crease lines delimiting the first panels than to transverse crease lines of panels being further down in the transport direction. Also, the ending edge of a blank typically (unless some cardboard is cut-out) defines the position of the leading edge of a subsequent blank, which is the reason why according to at least one embodiment of the invention it is upon deciding, which specific blank layout will be created, also taken into account, if a certain blank layout would result in a transverse fold being present shortly behind the ending edge, i.e. outside the current blank. The area of a specific crease line or edge, in which no transverse folds should be present, hence depends on different criteria and advantageously at least one embodiment of the invention allows the user to adjust the minimum distance between transverse crease lines and transverse folds for the specific individual case. It may also be that the distance depends on the box size. The system may also be designed as self-learning system learning to adjust the distances based on experience for example with jams of the system.

The method further comprises an act of obtaining information on the presence of transverse folds in cardboard ready to be cut-off from a first web of fanfold cardboard. Ready to be cut-off means the cardboard at the current front of the web, which will be processed in case the web is used for making a blank. As set out above, it is not only looked at the cardboard having the desired length but also further downstream to cover the area behind the ending edge. The information can be obtained by using sensors in contact with the web or sensors working contactless like for example optical or ultrasound sensors measuring the distance from the sensor to a surface of the web, which distance increases or decreases when a transverse fold is present. It can also be obtained by calculation, as the panels in a fanfold stack of cardboard typically have even lengths. However, due to the nature of the material and for the reasons set out below, the transverse folds may have different extensions in the longitudinal direction, so that it is preferred to use sensors. The information obtained may not only contain information on the presence and the position of the transverse folds with respect to a leading edge of the web, but also on the longitudinal extension of the transverse folds or the folding direction in the fanfold stack. In a preferred embodiment, both sides of the web are checked for the presence of transverse folds, which depending on the material used and the position of the transverse fold in the material may on one side of the cardboard form an indentation and may on the opposite side form a ridge, which can be alternately the case due to the orientations of the transverse folds in the fanfold stack. As the folding force required to fold such transverse fold also differs depending on the orientation of the transverse fold in the fanfold stack, the behavior to act upon this can be adapted to this as well. As the cardboard is a substantially flat sheet like material, it is common to speak of the "two" sides of the cardboard, which are the main surface areas, while of course the cardboard has a certain thickness and hence also small surface areas/sides between the main surface areas. The leading edge of the web is the transverse edge between the longitudinal edges of the web that is the first edge in the transport and/or processing direction of the web. From this edge in the opposite longitudinal direction the length of the cardboard cut-off from the web for forming a blank is determined.

In a next act, it is checked if transverse folds are present in said areas where they would interfere with transverse crease lines and edges. If no transverse folds are present in said areas, the piece of cardboard is cut-off and the desired blank is formed in manner known in the art by forming crease lines on the piece of cardboard and, depending on the respective packaging that shall be folded, incisions or cut-outs facilitating certain folding operations. A respective system for cutting and creasing the cardboard comprises structure for cutting (which may also include die cutting), like rotating or reciprocating knifes, lasers, die cutters etc. and structure for creasing, like crease rollers, moving stamps etc.

If however a transverse fold is present in at least one of said areas, at least one of the acts of A) calculating a second blank layout for folding the same packaging, said second layout comprising transverse and longitudinal crease lines at different positions than the first layout, B) enlarging at least one of the panels by shifting a respective transverse crease line and the ending edge, and C) obtaining information on the presence of transverse folds in cardboard ready to be cut-off from at least one additional web of fanfold cardboard, and, if no transverse folds are present in said areas, cutting-off a piece of cardboard of the desired length from the at least one additional web, is performed. If one of these acts does not lead to the wanted result, a blank layout having no transverse folds in the areas in the blank or behind the ending edge, the user may advantageously assign priorities respectively define an order, in which one or more of the other acts are performed. For example, it is, as mentioned above, within the boundaries imposed by the dimensions of the web, in particular the width of the web—often possible to calculate a second blank layout, in which some of the panels have interchanged width and length dimensions with respect to the first layout, which will result in the "same" packaging, i.e. a packaging, for example a box, that from the perspective of a user of the box has the same dimensions, which thus does not affect shipping cost based on the volume of a packaging and which may be the solution preferred by a user. However, such layout may be associated with more waste material as for example the panels may have more distance to the longitudinal edges of the web, and hence the cost if the waste material be also taken into account and it may be easily evaluated using a look-up table or a formula for calculating shipping costs and cost of waste material, which solution is most cost efficient. At least one embodiment of the invention advantageously allows the user to define his preferred optimization criteria.

In a preferred embodiment, the group of acts optionally performed in case a transverse fold is present in at least one of said areas further comprises further an act D) of cutting-off a certain amount of the cardboard ready to be cut-off from the web of fanfold cardboard to be used for the blank to eliminate a transverse fold and/or to shift the position of the transverse folds with respect to the leading edge of the web, which may be a fast solution in case none of the acts A) to C) leads to a blank layout fulfilling the users criteria. Alternatively or additionally, the group of acts optionally performed in case a transverse fold is present in at least one of said areas may further comprise an act E) of calculating based on order information of a subsequent packaging at least a first blank layout for folding the packaging, and checking, if transverse folds in the cardboard ready to be cut-off would interfere with the transverse crease lines and the leading and ending edges in this layout and, if not, processing the subsequent packaging first. Alternatively or additionally, the group of acts optionally performed in case a transverse fold is present in at least one of said areas may further comprising an act of F) of ignoring the presence of the transverse fold, which can be possible in certain cases. In a preferred embodiment, the method further comprises an act of evaluating under predefined optimization criteria, which of the group of acts is performed. In order to do so, the act of defining areas around the transverse crease lines, the leading edge and the ending edge, in which no transverse folds should be present, may advantageously comprise assigning different priorities to said areas and taking these priorities into account upon deciding, which acts shall be performed in case a transverse fold is present in said areas. Also, in yet a further embodiment obtaining information on the presence of transverse folds in the cardboard may include obtaining information on the fold orientation in the fanfold stack and taking the fold orientation into account upon deciding, which acts shall be performed in case a transverse fold is present in said areas.

According to one embodiment, a system for creating custom-sized cardboard blanks for folding packagings from a piece of corrugated cardboard cut-off from a web of fanfold cardboard, said cardboard having transverse folds from fanfolding, comprises a first and at least a second supply for supplying web of fanfold cardboard, a central control unit, sensors communicatively coupled with said control unit for obtaining information on the presence of transverse folds in cardboard ready to be cutoff from the first web, sensors communicatively coupled with said control unit for obtaining information on the presence of transverse folds in cardboard ready to be cutoff from the second web, and structure for cutting-off a piece of cardboard of the desired length from the first or the second web and forming the desired blank. The control unit may be adapted for calculating, based on order information regarding the desired minimum dimensions of a current packaging, under predefined optimization criteria a first blank layout for folding the packaging, said blank layout comprising a leading edge and an ending edge and transverse and longitudinal crease lines dividing the blank having a desired length and width into panels, defining, based on predefined criteria, areas around the transverse crease lines and the leading and ending edges, in which no transverse folds should be present, checking, if a transverse fold would present in at least one of said areas if the piece of cardboard would be cut-off form the first web and performing, in case such transverse fold would be present, at least one of the acts A) to C) defined above, preferably also to perform one of acts D) and E) defined above if none of the acts A) to C) lead to a desired blank layout.

A method for automatically packaging shipment sets in custom-sized cardboard boxes employing the method of creating a custom-sized cardboard blank for a shipment set to be packaged according to at least one embodiment of the invention may further comprising the acts of placing the shipment set to be packaged on a panel of the blank forming a bottom panel of a box and folding the remaining panels around the shipment set. In order to do so, the method may optionally comprising an act of turning the shipment set to be packaged by 90° in a plane parallel to the blank in case, it has been determined that a blank layout, in which the width and length of the bottom panel are interchanged, would fulfil the requirements with respect to the transverse folds.

A method for automatically packaging shipment sets in custom-sized cardboard may further comprise the acts of preparing two shipment sets on parallel arranging stations, determining a blank layout for both shipment sets, determining based on information about transverse folds present in cardboard ready to be cut-off from a web of fanfold cardboard, which shipment set shall be packaged first and transporting the shipment to be packaged first onto a respective cardboard blank produced first.

Further details and advantages of the various embodiments of the invention will become apparent from the following non-limiting description of preferred embodiments in conjunction with the drawing, which comprises ten figures.

DESCRIPTION OF PREFERRED EMBODIMENTS

Figure 1:
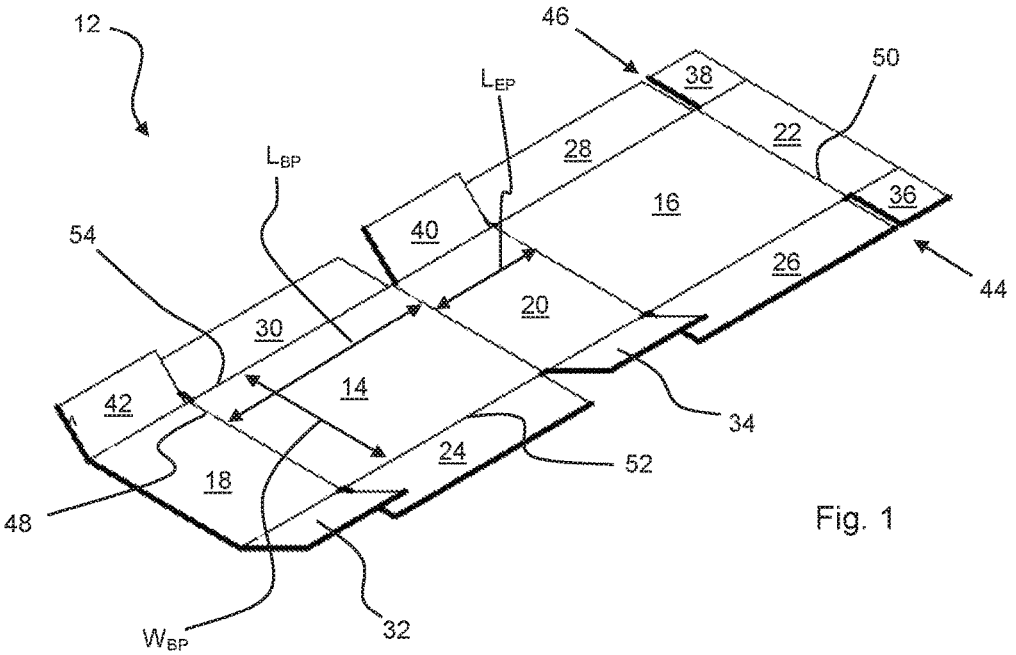
FIG. 1 is a perspective drawing of a blank for a packaging.

In order to better understand the advantages of the invention, FIG. 1 shows a typical custom-sized cardboard blank 12 for folding a packaging, namely in this case a box including a lid. The blank 12 has a so-called bottom panel 14, a top panel 16, a first end panel 18, a second end panel 20, a third end panel 22, side panels 24, 26, 28 and 30 and corner panels 32, 34, 36, 38, 40 and 42. The respective panels are delimited from each other by incisions or cut-outs like the cut-outs 44 and 46, transverse crease lines like the crease lines 48 and 50 and longitudinal crease lines like the crease lines 52 and 54. As known in the art, certain crease lines running in the same direction may be offset with respect to each other to take into account the thickness of the cardboard and facilitate folding cuboid boxes with orthogonal panels. To facilitate understanding the layout, the corner panels 32, 34, 40 and 42 are in the shown situation slightly lifted from the normally flat laying position. When the blank is created, all panels lie flat in the same plane.

The length of the box to be folded from blank 12 is determined in this layout by the length $L_{BP}$ of the bottom panel 14 (which corresponds to the length of the top panel 16 and the respective side panels 24, 26, 28 and 30). The width of the box is determined by the width $W_{BP}$ of the bottom panel 14 (which corresponds to the width of top panel 16 and the first, second and third end panels 18, 20, 22). The height of the box is determined by the length $L_{EP}$ of the second end panel 20 (which in this embodiment corresponds to the length of the first end panel 18).

In a system using a blank 12 as shown in FIG. 1, a shipment set comprised of one or more items is placed on the bottom panel 14, and the first end panel 18 and the second end panel 20, to which the top panel 16 and its adjacent panels are attached, are erected. The corner panels 32, 34, 40 and 42 are folded inwards, the side panels 24 and 30 are folded upwards, the top panel 16 is folded downwards onto the thus formed open box, the third end panel 22 is folded downwards, the corner panels 36 and 38 are folded inwards, and finally the side panels 26 and 28 are folded downwards. Some of the acts do not need to be performed in this order.

Figure 2:
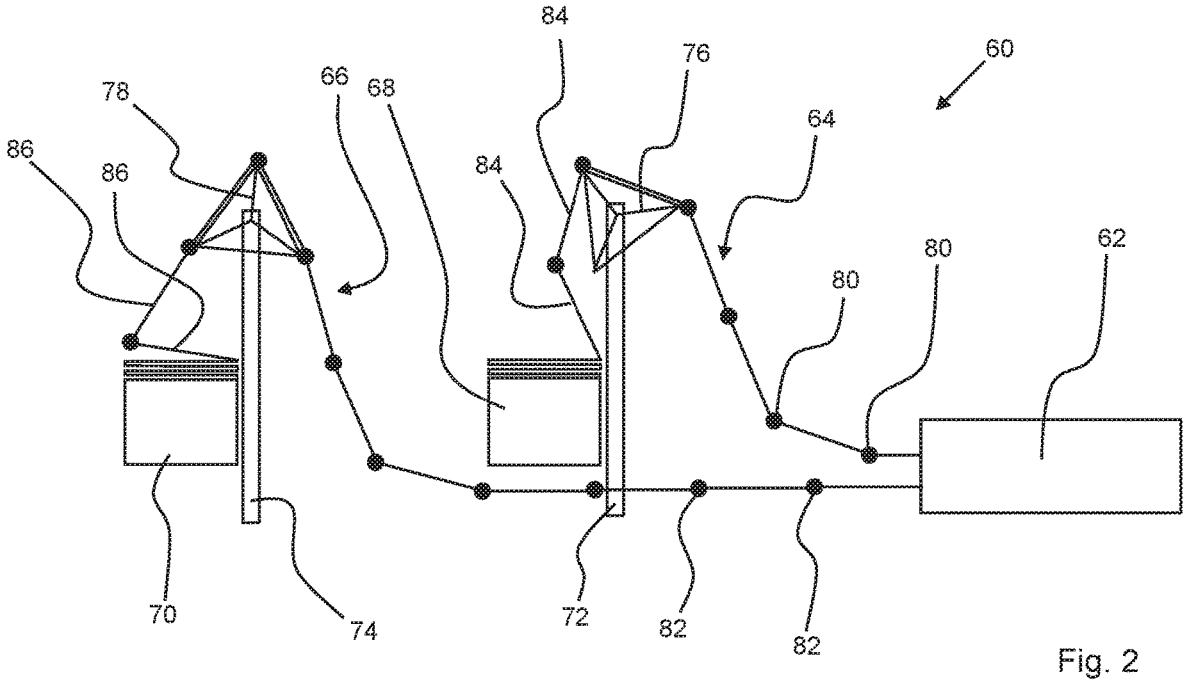
FIG. 2 is a schematic drawing of a system comprising two separate cardboard supplies.

FIG. 2 very schematically shows a system 60 for creating custom-sized cardboard blanks for folding packagings comprising a cutting and creasing station 62, in which in a manner known in the art structure for cutting like rotating or reciprocating knifes, lasers, die cutters etc. and structure for creasing, like crease rollers, moving stamps etc. are provided and to which cardboard 64, 66 is supplied from two separate supplies. Each supply comprises a stack 68 and 70 of fanfold cardboard, and guiding structure 72, 74 including turning support mechanisms 76, 78 facilitating drawing cardboard from the respective stack 68, 70 and guiding it to the station 62. Due to the fanfolding, the cardboard comprises transverse folds, the positions of which are indicated in FIG. 2 and some of the following figures by black circles 80, 82, of which for sake of clarity only some have been provided with reference numbers, and which delimit the cardboard panels 84, 86 forming the respective stacks 68, 70. Again, only some of the panels 84, 86 have been provided with reference numbers.

Figure 3A:
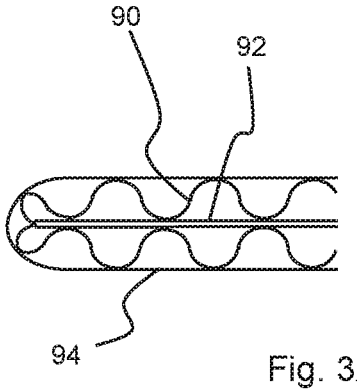
FIGS. 3A-3F are schematic drawings showing portions of panels of double-faced corrugated cardboard in a folded and an unfolded state.
Figure 3B:
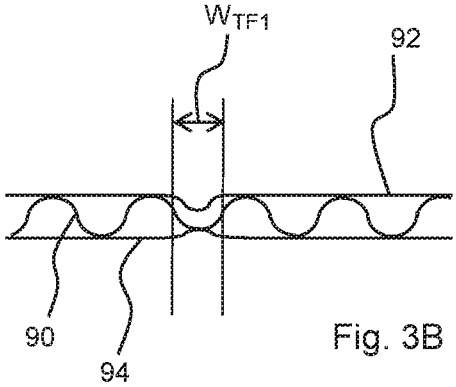
Figure 3C:
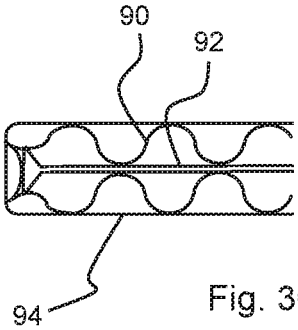
Figure 3D:
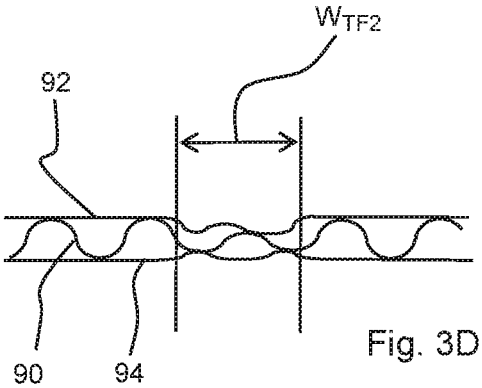
Figure 3E:
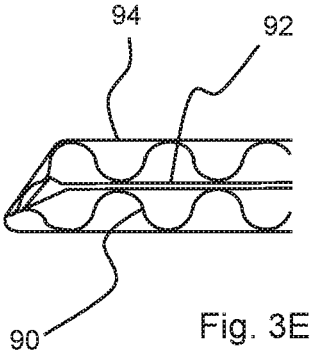
Figure 3F:
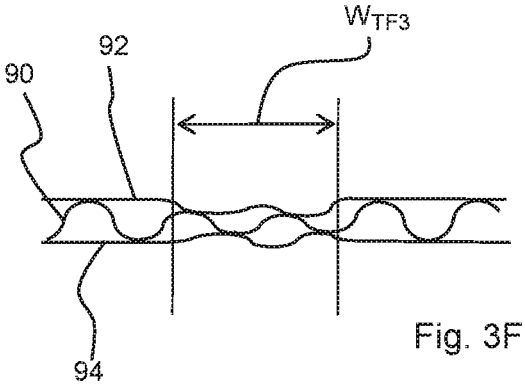

As previously mentioned, due to the nature of double-faced corrugated cardboard, fanfolding it leads to transverse crease lines having a structure that amongst others depends on the position, where the cardboard is folded. FIG. 3A to 3F are schematic drawings of a cut through a portion of two panels of double-faced corrugated cardboard. In each panel, a corrugated layer 90 is sandwiched between two flat layers 92, 94. FIGS. 3A, 3C and 3E show the two panels folded onto each other at different positions with respect to the course of the corrugated layer 90. FIGS. 3B, 3D and 3F show the principle structure a transverse crease line would have when the panels are unfolded. The extension of the transverse folds in the longitudinal direction is indicated by the respective double-sided arrow $W_{TF1}$, $W_{TF2}$, $W_{TF3}$.

Figure 4:
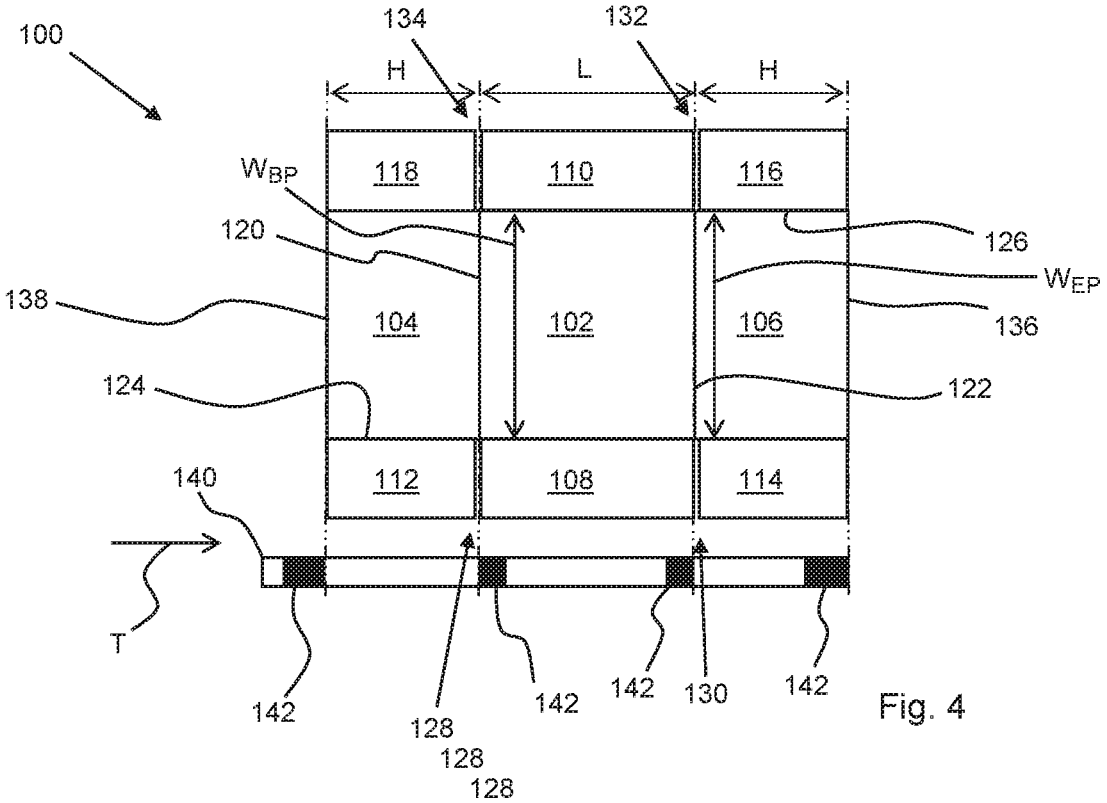
FIG. 4 is a view onto a blank for an open box including a schematic indication of areas, in which no transverse folds should be present.

FIG. 4 shows a blank 100 for an open box. The blank comprises a bottom panel 102, two end panels 104, 106, two side panels 108, 110 and four corner panels 112, 114, 116 and 118. The panels are delimited from each other via transverse crease lines 120, 122, longitudinal crease lines 124 and 126, incisions 128, 130, 132 and 134, a so-called leading edge 136 and an ending edge 138. As previously explained, the terms "leading" and "ending" originate from the transport direction T, in which cardboard is fed to a respective cutting station, which cuts off the piece of cardboard from which the shown blank 100 is formed. Prior to cutting-off the blank, edge 136 formed the leading edge of the web fed into the cutting station. Once cut-off, the opposite edge of the cardboard piece forms the end of the blank 100 and is therefore called the "ending edge" 138.

While the crease lines 124 and 126 in the schematic drawing appear to be two parallel straight lines, in fact these lines may, depending on the thickness of the cardboard, be comprised of three slightly offset sections giving the end panels 104, 106 a different width $W_{EP}$ than the width $W_{BP}$ of the bottom panel 104.

In the shown embodiment, the length $L_{BP}$ of the bottom panel 104 determines the length L of a box to be folded, while the length $L_{EP}$ of the end panels 106, 108 determines the height H of the box to be folded.

As schematically indicated by the strip 140 shown beneath the blank, to each transverse crease line and in this case also to the leading edge 136 and the ending edge 138, an area 142 is defined, indicated by the black rectangles, in which no transverse folds should be present. Next to the leading edge 136, no transverse fold should be present in order to facilitate gripping the end panel 106 upon automated folding. Likewise, behind ending edge 138, where the next blank will begin, no transverse fold should be present, as this will become a transverse fold near the leading edge of the next blank. Behind transverse crease line 122 and before transverse crease line 120, no transverse folds should be present. As schematically indicated in FIG. 4, the areas, in which no transverse folds should be present, differ in their longitudinal extension, which, as explained above, can have several reasons. At least one embodiment of the invention advantageously allows to adjust these areas based on the material used, the mechanics of a machine used for automatically folding a respective blank, user experience and other criteria in order to minimize the areas, i.e. the distance between transverse crease lines and transverse folds, which gives most freedom in creating the blanks. Accordingly, the act of defining areas around the transverse crease lines, the leading edge and the ending edge, in which no transverse folds should be present, may comprise assigning different priorities to said areas and taking these priorities into account upon deciding, which acts shall be performed in case a transverse fold is present in said areas.

Figure 5:
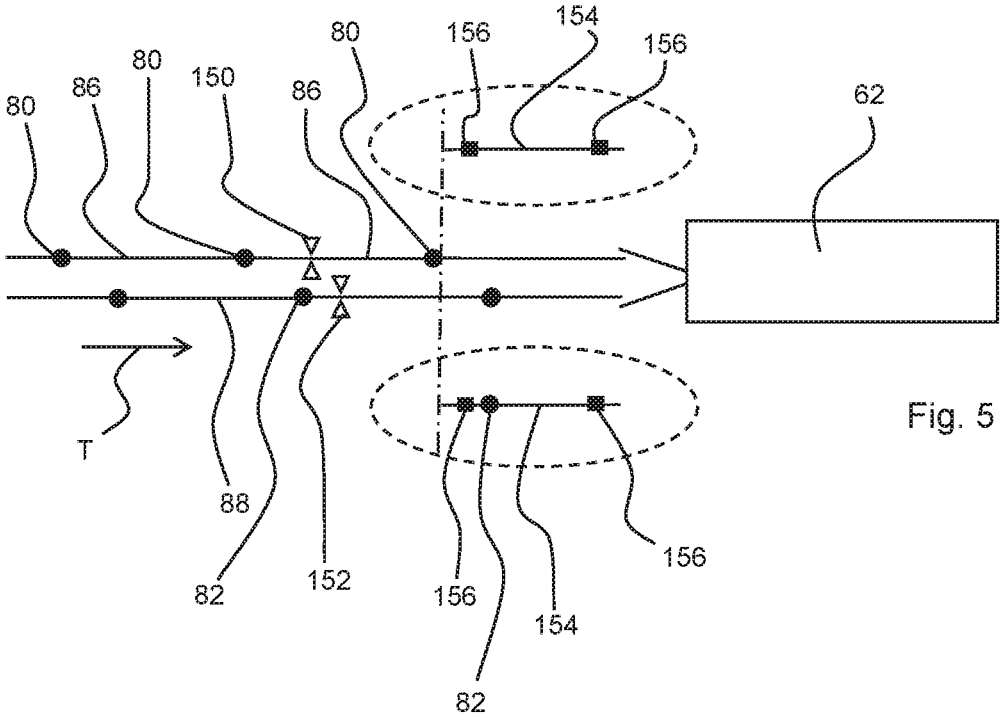
FIG. 5 is a schematic drawing explaining the advantage of using two separate cardboard supplies.

FIG. 5 shows schematically the advantage of having two separate cardboard supplies supplying cardboard webs with panels 86 and 88, of which again only some are provided with reference numbers, in transport direction T to a cutting and creasing station 62. Sensors 150, 152 detect the presence of transverse folds again indicated by black circles 80 and 82. A specific blank layout is calculated based on corresponding order information. The blank having the layout is schematically indicated by line 154 comprises two areas indicated by black rectangles 156, in which no crease lines shall be present. The layout is virtually, i.e. by a corresponding control unit, matched with the actual situation of the cardboard ready to be cut as indicated by the dashed and the dash-dotted lines. If cardboard from the supply, which in FIG. 5 is the upper supply, would be used, no transverse fold would be present in the blank 154. However, the cardboard would be cut off very close to a transverse fold 80, which would mean that a next blank cut off from the respective cardboard would have a transverse fold close to the leading edge, which is generally not wanted. If cardboard from the supply is used that in FIG. 5 forms the lower supply, the blank would comprise a transverse fold 82, but this would be positioned outside the areas indicated by the black rectangles 156, in which no transverse fold should be present. Hence, for creating the blank in the situation shown in FIG. 5, cardboard from the lower supply would be used, i.e. the web of the lower supply would be advanced into the cutting and creasing station 62 and a piece of cardboard having the necessary length would be cut off from the respective web.

Figure 6:
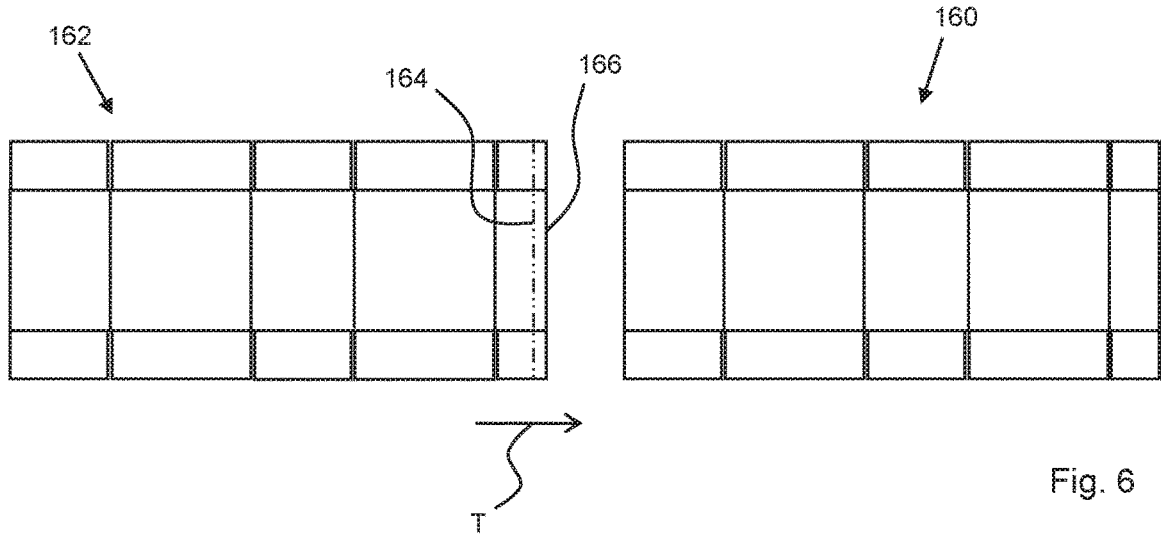
FIG. 6 is a schematic drawing showing two consecutive blanks formed from consecutive pieces of cardboard cut-off from the same cardboard web, in which an unwanted transverse fold is present in one of the blanks.
Figure 7:
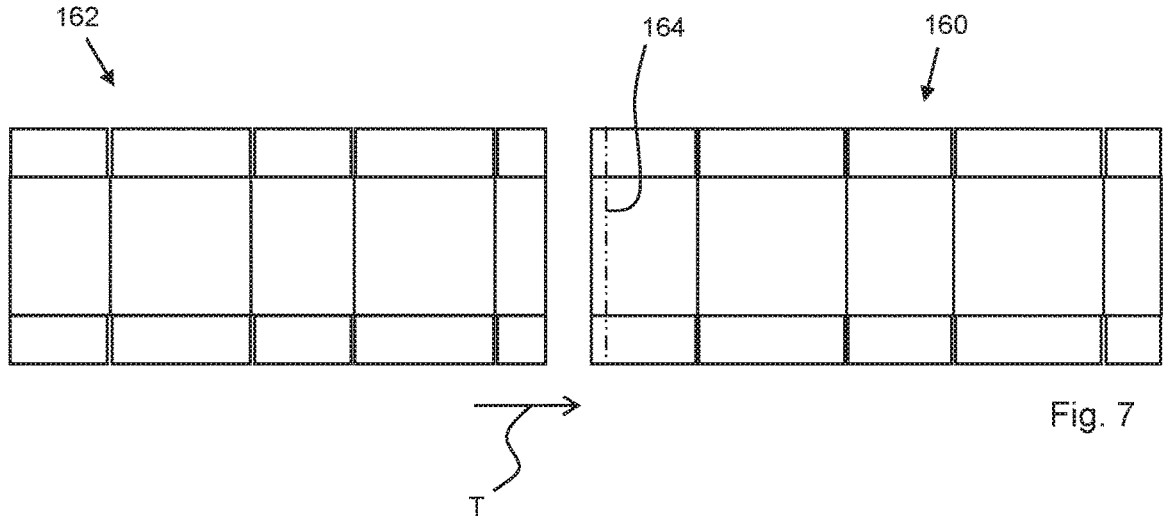
FIG. 7 shows one possible solution to deal with the problem shown in FIG. 6.
Figure 8:
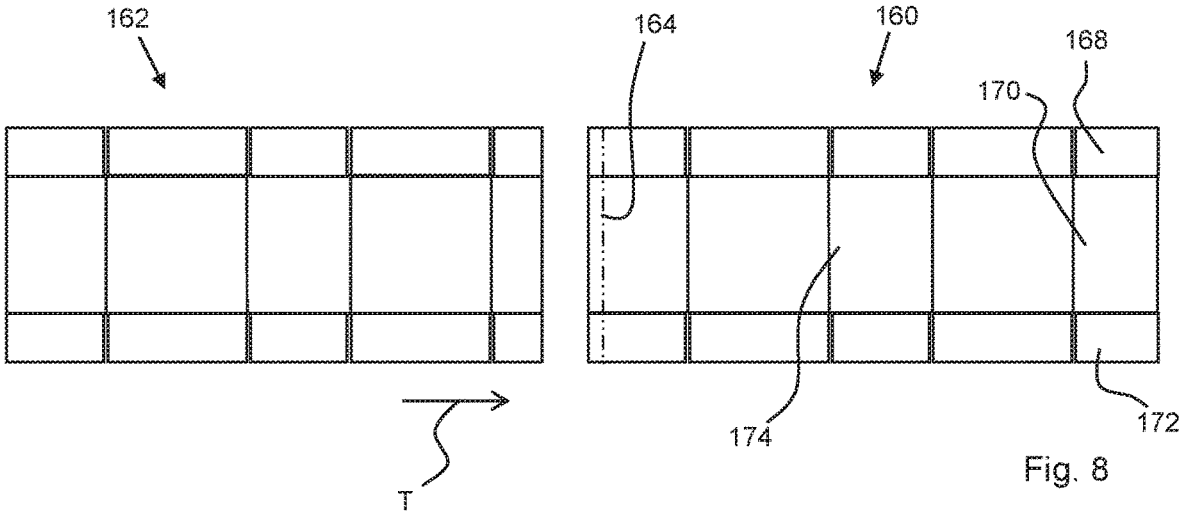
FIG. 8 shows another possible solution to deal with the problem shown in FIG. 6.

FIGS. 6, 7 and 8 show different approaches of shifting an unwanted transverse fold to a position, where it does not have a negative effect. In the figures, 160 indicates a calculated first blank layout for a blank that shall currently be produced, whereas 162 indicates the calculated blank layout for a subsequent blank to be produced from the same cardboard web. Hence, for calculating purposes, there would be no gap between the blank layouts. The dash-double-dotted line 164 indicates the position of a transverse fold.

If a blank having the layout 160 would be cut as indicated in FIG. 6, the subsequent blank having the layout 162 would have the transverse fold 164 close to the leading edge 166, which, for the reasons set out above, is typically not wanted. To avoid this, one solution is shown in FIG. 7, in which the lengths of all panels of blank layout 160 in the transport direction T are slightly increased, bringing the transverse fold 164 into the end panels of the blank layout 160, where it does not have an adverse effect. However, as all panels are slightly increased in length, a box folded from the blank 160 shown in FIG. 7 would have a slightly larger volume than a box folded from a blank having the layout 160 shown in FIG. 6. As typically the transportation costs do not only depend on weight, but also on volume, increasing the length of all panels is only a suboptimal solution, in particular as it also requires more cardboard.

FIG. 8 shows a solution, in which the lengths in the transport direction T of the front panels 168, 170, 172 of blank layout 160 are slightly increased, also shifting the transverse fold 164 from the front panels of box layout 162 to the rear panels of blank layout 160. This is possible when blank layouts are used, in which, as in the shown embodiment, the length of the front panels 168, 170, 172 is less than the length of the panels, which determine the height of the packaging being folded from the corresponding blank (in the shown embodiment, the length of panel 174 determines the height of a box). This allows that the length of the panels 168, 170 and 172 can be increased up to the height of the length of panel 174 without changing the volume of a box folded from such blank. Thus, although slightly more material is for used for the respective blank layout 160 in FIG. 8, still the transportation costs based on volume of the box would not be affected.

Figure 9:
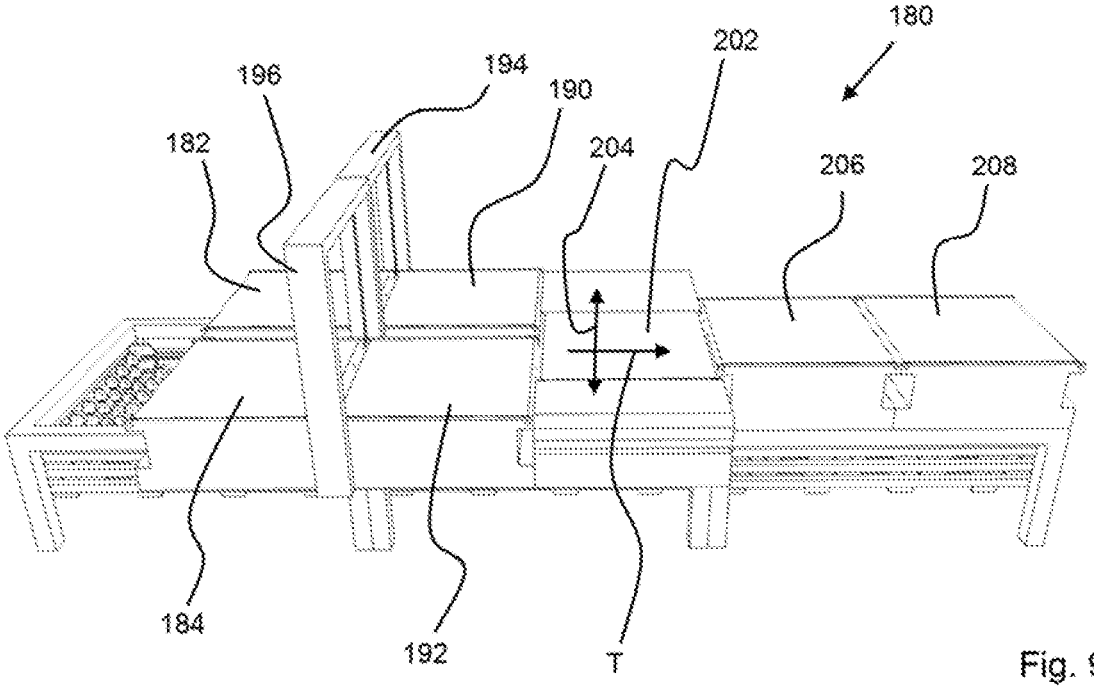
FIG. 9 is a schematic perspective drawing showing a system comprising two separate assembly stations for assembling items to be shipped.
Figure 10:
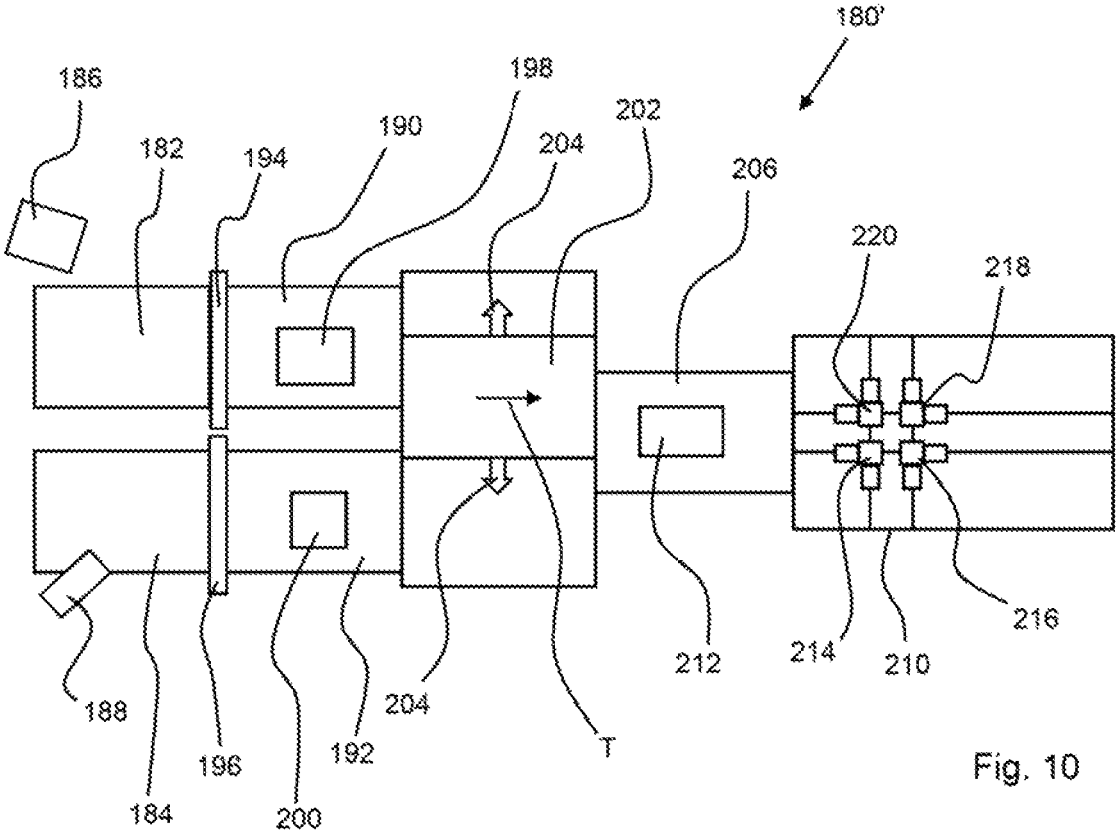
FIG. 10 is a schematic top view of a system according to FIG. 9 to explain the way the system works.

FIGS. 9 and 10 show very schematically some parts of two highly similar systems 180, 180' for packaging shipment sets in custom-sized boxes. In the shown embodiments, both systems comprise two arranging stations, each comprising a first conveyor 182, 184, where shipment sets of one or more items are arranged in a configuration suitable for being automatically packaged. In FIG. 10, rectangles 186, 188 schematically indicate delivery of such shipment sets for being arranged at the respective stations.

Once arranged, the item(s) forming a shipment set are transported with the first respective first conveyors 182, 184 onto respective second conveyors 190, 192 through respective laser scanner 194, 196 for determining the maximum outer dimensions of the arrangement, which allows in a manner known per se to calculate the dimensions of a respective box needed for packaging the shipment set. As set out above, a control unit (not shown) calculates box layouts necessary for forming packagings for both shipment sets and determines which blank layout shall be produced first based on information on the presence of transverse folds in cardboard ready for being used for making the blanks. Of course, such system may be provided with more than one supply unit for supplying cardboard, which gives further flexibility in optimizing the blanks while avoiding the presence of transverse folds in certain areas. As two separate conveyors 182, 190 respectively 184, 192 are associated with each arranging station, new items 186, 188 can already be received for being arranged while already prepared and scanned arrangements 198, 200 schematically indicated in FIG. 10 wait on conveyors 190, 192 for being further processed. Once the control unit decided, which arrangement 198, 200 shall be processed first, a merge conveyor 202, typically comprising a conveyor belt for transporting arrangements in transport direction T and being itself moveable between the conveyors 190, 192 as indicated by the arrows 204, picks up either one of the arrangements 198 and 200 ready for being packaged. The merge conveyor 202 transports the arrangements onto a further conveyor 206 leading towards yet a further conveyor 208 (FIG. 9), giving the system more flexibility with respect to the handling speed, or (FIG. 10) directly towards a packaging station 210.

As schematically indicated in FIG. 10, a previously prepared and selected arrangement 212 is being transported via the conveyor 206 to packaging station 210, where the arrangement 212 will be placed on the bottom of a corresponding custom-sized blank, upon which gripping and folding units 214, 216, 218 and 220, which are positionable for handling a custom-sized blank by being movable in two directions in the plane of a blank, will fold the panels of the blank around the shipment set as known in the art and briefly described above.

The systems 180, 180' or an alternative system for automatically packaging shipment sets in custom-sized cardboard boxes, may, in addition to a first and at least a second supply for supplying web of fanfold cardboard, a central control unit adapted for performing the aforementioned acts, sensors communicatively coupled with said control unit for obtaining information on the presence of transverse folds in cardboard ready to be cut-off from the first web and from the second web, structure for cutting-off the piece of cardboard from the first or the second web and forming the desired blank, structure for transporting a shipment set onto a blank produced according to one of the aforementioned method, and structure for folding a box from the blank around said shipment set also comprise structure for turning the shipment set to be packaged by 90° in a plane parallel to the blank, which would allow to use a blank layout, in which the width and length dimension of the bottom panel are interchanged.

Various embodiments of the devices and/or processes via the use of block diagrams, schematics, and examples have been set forth herein. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via integrated circuits, as one or more computer programs running on one or more computers (e.g., as one or more programs running on one or more computer systems), as one or more programs running on one or more control units (i.e., controllers or other processors (e.g., microcontrollers, microprocessors, application specific integrated circuits (ASICs), field programmable gate arrays (FPGAs), digital signal processors (DSPs), graphics processing units (CPUs) programmable logic controllers (PLCs)) as one or more programs running on one or more processors, as firmware, or as virtually any combination thereof, and that designing the circuitry and/or writing the code for the software and or firmware would be well within the skill of one of ordinary skill in the art in light of this disclosure.

When logic is implemented as software and stored in memory, one skilled in the art will appreciate that logic or information, can be stored on any computer- or processor-readable medium for use by or in connection with any computer and/or processor related system or method. In the context of this document, a memory is a computer- or processor-readable medium that is an electronic, magnetic, optical, or other another physical device or means that contains or stores a computer and/or processor program. Logic and/or the information can be embodied in any computer readable medium for use by or in connection with an instruction execution system, apparatus, or device, such as a computer-based system, processor-containing system, or other system that can fetch the instructions from the instruction execution system, apparatus, or device and execute the instructions associated with logic and/or information. In the context of this specification, a "nontransitory computer- or processor-readable medium" can be any nontransitory physical structure can store, communicate, propagate, or transport the program associated with logic and/or information for use by or in connection with the instruction execution system, apparatus, and/or device. The computer- or processor-readable medium can be, for example, but not limited to, an electronic, magnetic, optical, electromagnetic, infrared, or semiconductor system, apparatus, device. More specific examples (a non-exhaustive list) of the computer- or processor-readable medium would include the following: a portable computer diskette (magnetic, compact flash card, secure digital, or the like), a random access memory (RAM), a read-only memory (ROM), an erasable programmable read-only memory (EPROM, EEPROM, or Flash memory), and a portable compact disc read-only memory (CDROM). Note that the computer- or processor-readable medium could even be another suitable nontransitory medium upon which the program associated with logic and/or information is stored.

In addition, those skilled in the art will appreciate that certain mechanisms of taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as floppy disks, hard disk drives, CD ROMs, digital tape, and computer memory.

The various embodiments described above can be combined to provide further embodiments.

From the foregoing it will be appreciated that, although specific embodiments have been described herein for purposes of illustration, various modifications may be made without deviating from the spirit and scope of the teachings. Accordingly, the claims are not limited by the disclosed embodiments.

The invention claimed is:

1. A method for creating custom-sized cardboard blanks for folding packagings from a piece of corrugated cardboard cut-off from a web of fanfold cardboard, said cardboard having transverse folds from fanfolding, the method comprising:

calculating, based on order information regarding the desired minimum dimensions of a current packaging, under predefined optimization criteria a first blank layout for folding the packaging, said blank layout comprising a leading edge and an ending edge and transverse and longitudinal crease lines dividing a blank having a desired length and width into panels, said transverse crease lines separate from said transverse folds, defining, based on predefined criteria, areas around the transverse crease lines, the leading edge and the ending edge, in which none of the transverse folds should be present, obtaining information on the presence of said transverse folds in cardboard ready to be cutoff from a first web of fanfold cardboard and checking, if said transverse folds are present in said areas, if none of the transverse folds are present in said areas, cutting-off a piece of cardboard and forming the desired blank, and if one of the transverse folds is present in at least one of said areas, performing at least one of the following steps:

A) calculating a second blank layout for folding the same packaging, said second layout comprising transverse and longitudinal crease lines at different positions than the first layout, B) enlarging at least one of the panels by shifting a respective transverse crease line and the ending edge, C) obtaining information on the presence of said transverse folds in cardboard ready to be cut-off from at least one additional web of fanfold cardboard, and, if none of the transverse folds are present in said areas, cutting-off a piece of cardboard of the desired length from the at least one additional web.

2. The method according to claim 1, wherein if one of the transverse folds is present in at least one of said areas, the method further comprises:

D) cutting-off a certain amount of the cardboard ready to be cut-off from the web of fanfold cardboard to be used for the blank to eliminate the transverse fold and/or to shift the position of the transverse folds with respect to the leading edge of the web.

3. The method according to claim 1, wherein if one of the transverse folds is present in at least one of said areas further comprising:

E) calculating based on order information of a subsequent packaging at least a first blank layout for folding the packaging, and checking, if any of the transverse folds in the cardboard ready to be cut-off would interfere with the transverse crease lines and the leading and ending edges in this layout and, if not, processing the subsequent packaging first.

4. The method according to claim 1, wherein if one of the transverse folds is present in at least one of said areas, the method further comprises evaluating under predefined optimization criteria which of said steps is performed.

5. The method according to claim 1, wherein the areas, in which none of the transverse folds should be present, have different extensions in the longitudinal direction of the blank layout.

6. The method according to claim 1, wherein defining areas around the transverse crease lines, the leading edge and the ending edge, in which none of the transverse folds should be present includes assigning different priorities by a customer among priorities including minimized volume and maximized stability of the packaging for defining areas, taking these priorities into account upon deciding; which acts shall be performed in case one of the transverse folds is present in said areas.

7. The method according to claim 1, wherein obtaining information on the presence of the transverse folds in the cardboard includes obtaining information on fold orientation in the fanfold stack and taking the fold orientation into account upon deciding, which acts shall be performed in case one of the transverse folds is present in said areas.

8. The method according to claim 1, further comprising:

placing a shipment set to be packaged on one of the panels of the blank forming a bottom panel of a box, and folding the remaining panels around the shipment set.

9. The method according to claim 8, further comprising: turning the shipment set to be packaged by 90° in a plane parallel to the blank.

10. The method according to claim 8, further comprising:

preparing two shipment sets on parallel arranging stations, determining a blank layout for both shipment sets, determining based on information about said transverse folds present in cardboard ready to be cut-off from a web of fanfold cardboard, which shipment set shall be packaged first, and transporting the shipment set to be packaged first onto a respective cardboard blank produced first.

11. A system for creating custom-sized cardboard blanks for folding packagings from a piece of corrugated cardboard cut-off from a web of fanfold cardboard, said cardboard having transverse folds from fanfolding, the system comprising:

a first and at least a second supply for supplying webs of fanfold cardboard, a central control unit adapted for:

calculating, based on order information regarding the desired minimum dimensions of a current packaging, under predefined optimization criteria a first blank layout for folding the packaging, said blank layout comprising a leading edge and an ending edge and transverse and longitudinal crease lines dividing a blank having a desired length and width into panels, said transverse crease lines separate from said transverse folds, and defining, based on predefined criteria, areas around the transverse crease lines and the leading and ending edges, in which none of the transverse folds should be present, sensors communicatively coupled with said control unit for obtaining information on the presence of transverse folds in cardboard ready to be cut-off from the first web, sensors communicatively coupled with said control unit for obtaining information on the presence of transverse folds in cardboard ready to be cut-off from the second web, and structure for cutting-off the piece of cardboard from the first or the second web and forming the desired blank, said central control unit further adapted for:

checking, if one of the transverse folds would be present in at least one of said areas if the piece of cardboard would be cut-off from the first web and performing, in case such transverse fold would be present, at least one of the following steps:

A) calculating a second blank layout for folding the same packaging, said second layout comprising transverse and longitudinal crease lines at different positions than the first layout, B) enlarging at least one of the panels by shifting a respective transverse crease line and the ending edge, C) checking, if one of the transverse folds would be present in at least one of said areas if the piece of cardboard would be cut-off from the second web, and, if none of the transverse folds are present in said areas, cutting-off the piece of cardboard from the second web.

12. The system according to claim 11, further comprising:

structure for transporting a shipment set onto the blank, and structure for folding a box from the blank around said shipment set, wherein the blank is produced by:

calculating, based on order information regarding the desired minimum dimensions of a current packaging, under predefined optimization criteria a first blank layout for folding the packaging, said blank layout comprising a leading edge and an ending edge and transverse and longitudinal crease lines dividing the blank having a desired length and width into panels, said transverse crease lines separate from said transverse folds, and defining, based on predefined criteria, areas around the transverse crease lines, the leading edge and the ending edge, in which none of the transverse folds should be present, obtaining information on the presence of said transverse folds in cardboard ready to be cutoff from a first web of fanfold cardboard and checking, if said transverse folds are present in said areas, if none of the transverse folds are present in said areas, cutting-off a piece of cardboard and forming the desired blank, and if one of the transverse folds is present in at least one of said areas, performing at least one of the following steps:

A) calculating a second blank layout for folding the same packaging, said second layout comprising transverse and longitudinal crease lines at different positions than the first layout, B) enlarging at least one of the panels by shifting a respective transverse crease line and the ending edge, C) obtaining information on the presence of said transverse folds in cardboard ready to be cut-off from at least one additional web of fanfold cardboard, and, if none of the transverse folds are present in said areas, cutting-off a piece of cardboard of the desired length from the at least one additional web.

13. The system according to claim 12, further comprising:

at least two arranging stations for arranging shipment sets to be packaged in parallel, and at least one merge conveyor for transporting shipment sets from the arranging station to a box forming station for folding a box around the respective shipment set.

14. The system according to claim 12, further comprising structure for turning the shipment set to be packaged by 90° in a plane parallel to the blank.

15. The system according to claim 11, wherein said central control unit is further adapted, such that if one of the transverse folds is present in at least one of said areas, for:

D) actuating the structure for cutting-off the piece of cardboard to cut-off a certain amount of the cardboard ready to be cut-off from the web of fanfold cardboard to be used for the blank to eliminate the transverse fold and/or to shift the position of the transverse folds with respect to the leading edge of the web.

16. The system according to claim 11, wherein said central control unit is further adapted, such that if one of the transverse folds is present in at least one of said areas, for:

E) calculating based on order information of a subsequent packaging at least a first blank layout for folding the packaging, and checking, if any of the transverse folds in the cardboard ready to be cut-off would interfere with the transverse crease lines and the leading and ending edges in this layout and, if not, processing the subsequent packaging first.

17. The system according to claim 11, wherein said central control unit is further adapted, such that if one of the transverse folds is present in at least one of said areas, for evaluating under predefined optimization criteria which of said steps is performed.

18. The system according to claim 11, wherein said central control unit is further adapted to define areas around the transverse crease lines, the leading edge, and the ending edge, in which none of the transverse folds should be present by assigning different priorities including minimized volume and maximized stability of the packaging, taking these priorities into account upon deciding which steps shall be performed in case one of the transverse folds is present in said areas.

19. The method according to claim 11, wherein the sensors are communicatively coupled with said control unit for obtaining information on the presence of the transverse folds in the cardboard to obtain information on fold orientation in the fanfold stack and taking the fold orientation into account upon deciding, which steps shall be performed in case one of the transverse folds is present in said areas.

* * * * *